US005240758A

United States Patent [19]

Honigberg

[11] Patent Number: 5,240,758

[45] Date of Patent: Aug. 31, 1993

[54] REVERSIBLE SKIRTING ASSEMBLY

[76] Inventor: Karen Honigberg, 23250 Park Corniche, Calabasas, Calif. 91302

[21] Appl. No.: 820,578

[22] Filed: Jan. 14, 1992

[51] Int. Cl.[5] ..... B32B 3/06

[52] U.S. Cl. ..... 428/100; 428/99; 160/330; 5/493

[58] Field of Search ..... 428/99, 100, 115, 28, 428/904.4; 160/330; 5/493

[56] References Cited

U.S. PATENT DOCUMENTS 3,368,601 2/1968 Gantert-Merz ..... 5/493

*Primary Examiner*—Alexander S. Thomas

*Attorney, Agent, or Firm*—Robbins, Dalgarn, Berliner & Carson

[57] ABSTRACT

A reversible skirting assembly for attachment to a base structure. The skirting assembly has a reversible main skirting panel and a reversible flap panel. Each panel has two surfaces and the panels extend from opposite edges of an attachment strip so that the first skirting panel surface and the second flap panel surface constitute a common face, and the second skirting panel surface and the first flap panel surface constitute a common face. The attachment strip has adhering means affixed to opposite sides and the adhering means are adapted to matingly engage an adhering element affixed to the base structure.

13 Claims, 2 Drawing Sheets

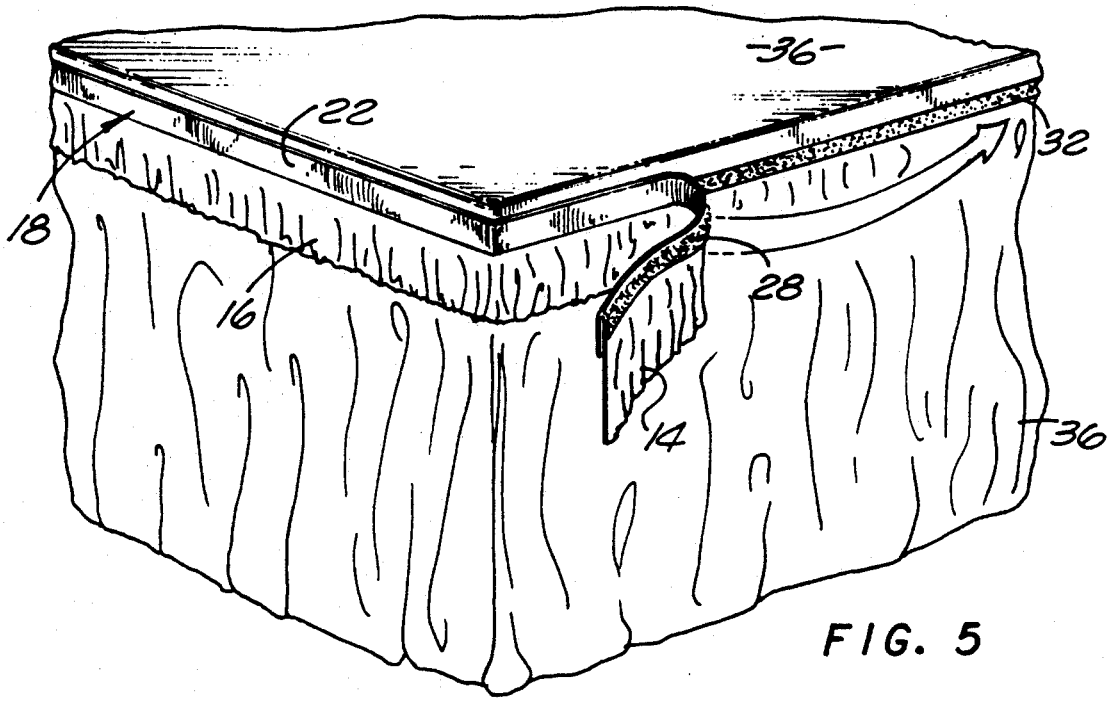
FIG. 5
FIG. 6
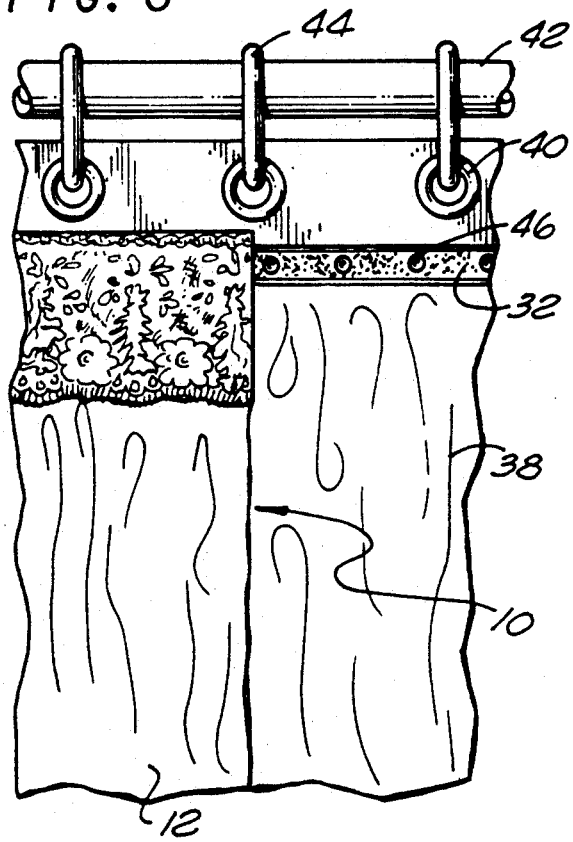
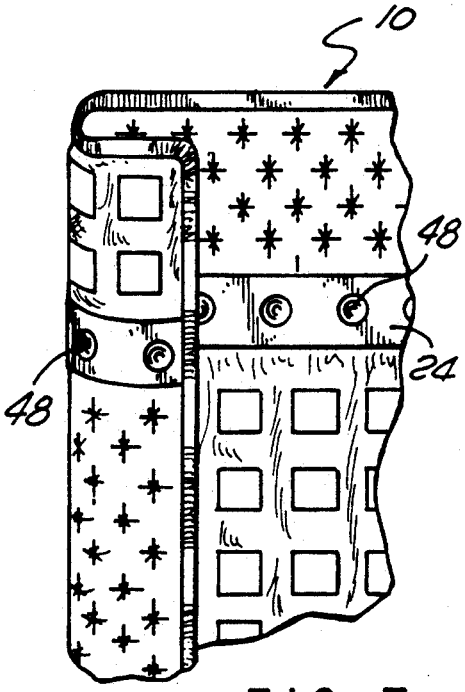
FIG. 7

REVERSIBLE SKIRTING ASSEMBLY

BACKGROUND OF THE INVENTION

The present invention relates to skirting for furniture and the like and, more particularly, to a reversible skirting assembly.

Originally decorative skirting was attached to a base structure, such as a cart, table or other item of furniture, or to curtains, simply by push-pins or t-pins to secure the top of the skirting the base material.

Nowadays, most skirting produced for commercial use in hotels and restaurants is provided with a dual element attachment system for removably affixing the skirting to the base structure in a more secure manner. For example, a base strip or clips containing a Velcro type surface affixed along the table edge is engaged by a mating Velcro strip sewn or otherwise affixed to the back of the skirting along its upper edge, or a strip with a series of mating hook or snap elements spaced at regular intervals along their length may be utilized. The skirting can thus easily be attached and securely held in place on the base structure during use, but easily removed for cleaning, storage or replacement.

Most commercial establishments, such as hotels and restaurants, maintain a variety of skirting assemblies with different colors and patterns to suit particular occasions. For example, a dark blue, solid colored skirting would be appropriate for the head table at a serious business or professional meeting, whereas a floral pattern with a lace trim might be better suited for more festive occasions, such as for a luncheon buffet table attended by a gardening group. Establishments must thus purchase and store a variety of different skirtings suitable for such different occasions which can be costly and wasteful of time, effort and storage space.

SUMMARY OF THE INVENTION

The present invention incorporates the advantages of easy attachment and removal of current dual element skirting assemblies but also has the additional advantage of reversibility so that a single skirting assembly can be used to provide two different skirting designs, thus saving cost, storage space and effort. This invention thus provides commercial establishments, such as restaurants and hotels, as well as home decorators, with a greater variety of skirting designs at reduced cost.

Specifically, the reversible skirting assembly of the present invention has a main body of the skirting that includes a first elongated fabric panel capable of having a different surface design on either side. A second elongated fabric panel with a shorter transverse dimension forms a flap that is joined along the top edge of the first fabric panel by a dual sided attachment strip. The flap panel preferably has matching or harmonizing surface designs on opposite sides, but with the designs on either side of the flap panel being reversed with respect to those on the first main panel. Thus, when the first side of the attachment strip is attached to a mating strip affixed to a base structure, the flap at the top of the skirting assembly hangs down in front of the base structure to cover the unattached second side of the attachment strip at the top of the main body of the skirting, thus presenting a coordinated design. On the other hand, when the second side of the attachment strip is secured to a base structure, the flap hangs downwardly in the other direction to display the alternate design applied on the other side of the panels to cover the first side of the attachment strip. By this means, the user can quickly and easily present two quite different decorative impressions simply by removing the skirting assembly from the base, moving the flap to the other side, and reattaching it with the sides reversed.

BRIEF DESCRIPTION OF THE DRAWINGS

These and other features of the present invention may be more fully understood from the following detailed description, wherein similar reference characters refer to similar elements throughout and in which:

FIG. 5 is detailed view of the banquet table of FIG. 4 with a skirting assembly in accordance with the invention shown partially detached from the tablecloth to illustrate the means of attaching the skirting assembly to the table edge;

FIG. 6 is a partial elevational view of a shower curtain incorporating a skirting assembly in accordance with the invention as an exterior decorative accent covering; and FIG. 7 is an elevational view of a skirting assembly with one face partially folded over the other face and incorporating snaps as the attachment means.

DESCRIPTION OF THE PREFERRED EMBODIMENT

Figure 1:
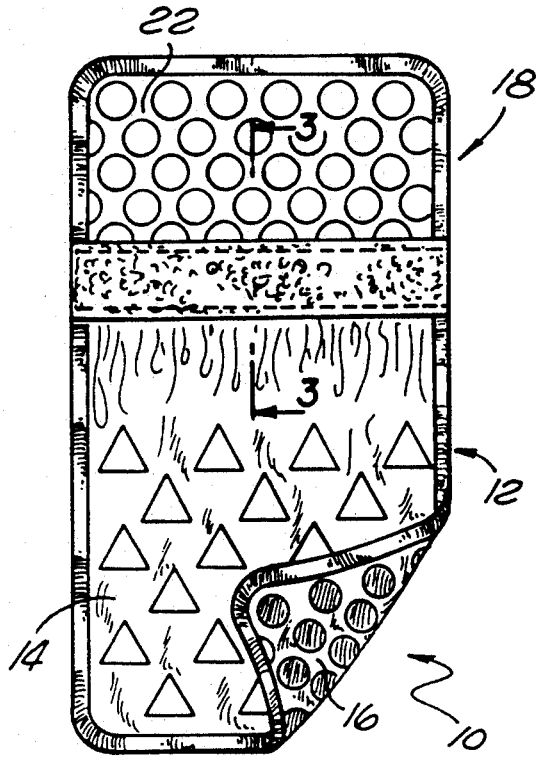
FIG. 1 is an elevational view of one face of a skirting assembly showing the joining of the main skirting panel to the flap panel by the dual sided attachment strip such that the first skirt side and the second flap side form a common face with the corner of the skirt panel folded to reveal the second skirt side.

Referring to FIG. 1, a preferred form of a skirting assembly 10 constructed according to the present invention has a first or main skirting panel 12, usually rectangular in shape, with a first skirt surface 14 and a second skirt surface 16 on opposite sides. The main skirt panel 12 preferably has a different design on one side of a single fabric layer, but may be constructed from two fabric panels sewn or otherwise attached together or from a single reversible fabric panel, with a design on either side.

Each surface of the skirting panel 12 has a design. In the embodiment shown in FIG. 1, each design is a geometric pattern. However, the design may be a solid color, a pattern woven into the fabric, the texture of the material, a pattern printed on the fabric, a composition of fabrics or any other suitable fabric surface. Additionally, although the designs in FIG. 1 are illustrated as different patterns, the designs may be identical in pattern or color or both.

Figure 2:
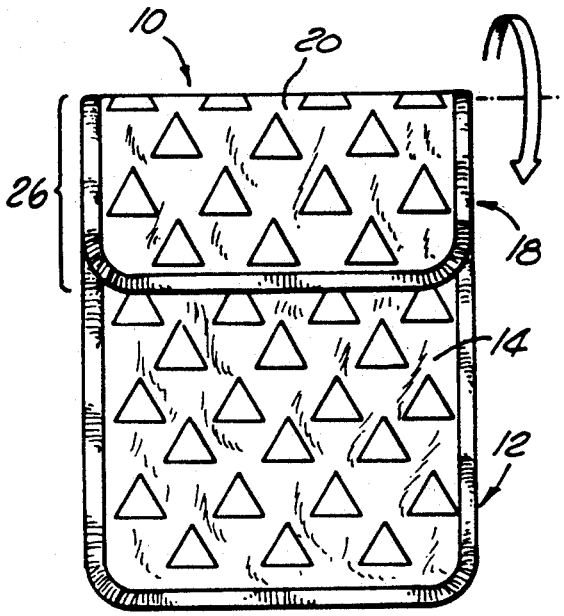
FIG. 2 is an elevational view of the skirting assembly of FIG. 1 with the flap panel folded over to cover the attachment means and form an exposed surface.

The skirting assembly 10 also has a second, generally rectangular, elongated fabric panel, or flap panel 18 with a first flap surface 20 (FIG. 2) and a second flap surface 22 on opposite sides. As with the skirting panel 12, each surface of the flap panel 18 has a design. As illustrated in FIGS. 1 and 2, the design on the first skirt surface 14 coordinates with the design on the first flap surface 20 and the design on the second skirt surface 16 coordinates with the design of the second flap surface 22. The designs may coordinate in terms of harmonizing colors, similar patterns, identical colors and patterns and other combinations suitable to combine as the surface of the skirting assembly 10 that is exposed to view after attachment to a base structure.

The longitudinal dimension of the flap panel 18 is substantially the same as the longitudinal dimension of the skirting panel 12. The lengthwise edges of an elongated attachment strip 24 are connected to one longitudinal edge of the skirting panel 12 and to an adjacent longitudinal edge of the flap panel 18, respectively. The skirting panel 12 may be gathered or pleated where it is attached to the attachment strip 24.

As illustrated in FIG. 1, the attachment strip 24 connects the skirting panel 12 to the flap panel 18 so that the panels extend from opposite edges of the attachment strip 24 with the first skirt surface 14 and the second flap surface 22 constituting a common face. Although not illustrated in FIG. 1, by inference the second skirt surface 16 and the first flap surface 20 also constitute a common face on the reverse side of the skirting assembly 10. Thus, the skirting assembly 10 when spread out flat on a surface has the first shirt surface 14 and the second flap surface 22 facing upward.

The transverse dimension 26 of the flap panel 18 is substantially less than the transverse dimension of the skirting panel 12. As illustrated in FIG. 2, the transverse dimension 26 of the flap panel 18 is prescribed by the length of fabric required to extend upwardly from, and then to fold over and cover the attachment strip 24. The transverse dimension of the skirting panel 12 is prescribed by the base structure and the amount of the base structure that is to be enhanced by the skirting assembly 10. The skirting panel 12 and the flap panel 18 are over locked along their peripheral edges to ensure that no unravelling of fabric occurs.

Figure 3:
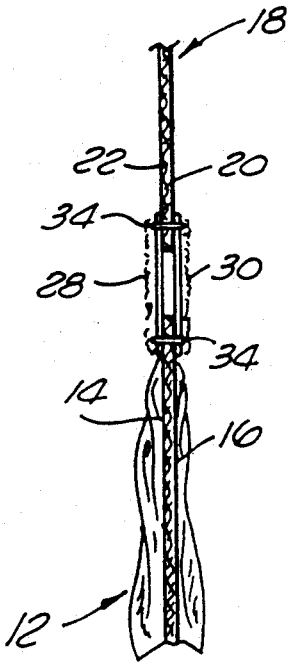
FIG. 3 is a cross-sectional view taken along the line 3—3 of FIG. 1.

Referring to FIG. 3, the attachment strip 24 has first adhering means 28 and second adhering means 30 affixed to opposite sides. The first and second adhering means 28 and 30 are adapted to engage a mating attachment element 32 affixed to the structure being skirted. (FIG. 5). In the illustrated embodiment of FIG. 3, the adhering means is a female Velcro type strip and the mating attachment element would be a male Velcro type strip. Other adhering means, such as snaps, hooks or eyelets may also be used. The adhering means is affixed to the attachment strip by sewing or other suitable means. Alternatively, strips of material carrying the adhering means may be sewn to the attachment strip.

In FIG. 3, the coextensive faces of the skirting assembly 10 are illustrated. The skirting panel 12 has a Design A on the first skirt surface 14 and a Design B on the underneath, second skirt surface 16. Also, the flap panel 18 has a Design A' on the first flap surface 20 and a Design B' on the underneath, second flap surface 22. The longitudinal edges of the skirting panel 12 and the flap panel 18 are sandwiched between the first adhering means 28 and the second adhering means 30 such that the first skirt surface 14 and the second flap surface 22 constitute a first common face, and the second skirt surface 16 and the first flap surface 20 constitute a second common face. The adhering means 28 and 30 and the longitudinal edges of the skirting panel 12 and the flap panel 18 are secured together, such as by stapling or stitching 34 that extends through all the layers.

Referring again to FIG. 2, due to the configuration of the skirting panel 12 and the flap panel 18 as joined by the attachment strip 24, when the flap panel 18 is folded over the attachment strip 24, the first adhering means 28 is covered from view and the exposed surface is a combination of the first skirt surface 14 and the first flap surface 20. Although not shown, the second adhering means 30 is uncovered to make contact with and mate with mating attachment element 32.

Figure 4:
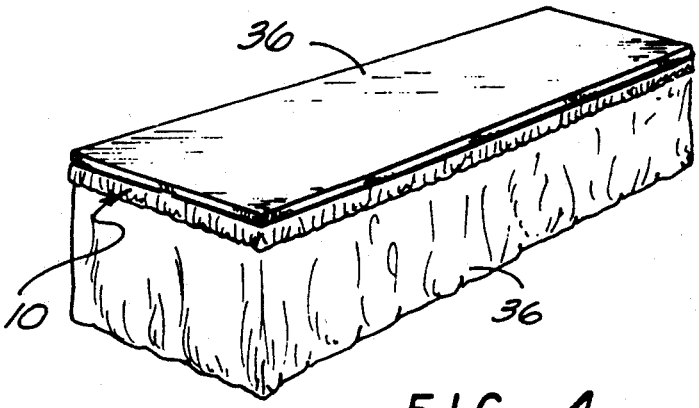
FIG. 4 is a perspective view of a banquet table covered by a tablecloth with a skirting assembly used as an accent around the upper perimeter of the tablecloth sides.

FIG. 4 illustrates the present invention used in combination with a underlying tablecloth 36 spread over a banquet table and extending down over the table legs. The skirting assembly 10 is attached to the tablecloth 36 near the edge of the banquet table to accent the tablecloth.

Details of the attachment of the skirting assembly 10 to the tablecloth 36 are illustrated in FIG. 5. In this embodiment, a mating attachment element 32, shown as a male Velcro type strip, and be sewn or otherwise affixed, such as by adhesive, to the tablecloth near the table edge. The flap panel 18 is folded over the second adhering means 30 (not shown) so that the exposed surface of the skirting assembly 10 is a combination of the second flap surface 22 and the second skirt surface 16. The first adhering means 28 is then uncovered at the back side of the exposed surface and may be mated with the mating attachment element 32.

The skirting panel 12 and the flap panel 18 may consist of a linen or tablecloth type fabric to harmonize the fabrics of the tablecloth 36 and the skirting assembly 10. As shown in FIG. 5, the skirting panel 12 may be pleated along its longitudinal edge where it is connected to the attachment strip 24.

An alternative decorative use of the skirting assembly on a curtain is illustrated in FIG. 6. A typical shower curtain 38 has grommets 40 along its upper longitudinal edge that are suspended from a shower rod 42 by means of detachable rings 44 that extend through the grommets 40 and encircle the shower rod 42. A male Velcro type strip or a mating attachment element 32 is attached to the shower curtain 38 below the grommets 40 by small eyelets 46. A skirting assembly 10 is then attached to the shower curtain 38 by mating an adhering means with the mating attachment element 32. The embodiment shown in FIG. 6 has the skirting panel 12 gathered along its longitudinal edge where it is connected to the attachment strip 24. The flap panel 18 consists of a lace-like fabric that accents the fabric of the skirt panel 12.

Referring to FIG. 7, an alternative embodiment of the skirting assembly is shown. The adhering means 28 and 30 in the embodiment consist of snap elements 48 affixed on opposite sides of the attachment strip 24. The skirting assembly 10 may be attached to a base structure on which mating snap elements 32 are affixed.

Although the specific preferred embodiments shown and described for clarity and to illustrate a diversity of uses, the present invention is not limited to those embodiments but rather is broadly applicable to various other skirting applications falling within the scope and spirit of the appended claims. For example, the mating attachment element 32 need not be sewn to a tablecloth, but can be directly attached, as it is in many instances, directly to the table edge or base structure with adhesive, tacks, removable clips or other suitable attachment means. The color, pattern or material of the design on the first skirt surface may be different from the color, pattern or material of the second skirt surface. Similarly, the design on the first flap panel may be identical to or match the design on the first skirt panel, or they may merely coordinate to form a suitable exposed surface. A reversible fabric having non-contrasting colors may be used for the skirting panel and the flap panel. Or a fabric with a pattern including a darker background on one surface and a solid design of the background color on the other surface may be used for the panels.

What is claimed is:

1. A reversible skirting assembly for base structures, such as furniture and curtains, comprising:

a first fabric panel having a first skirt surface and a second skirt surface, each surface bearing a design;

a second fabric panel having a longitudinal dimension substantially the same as the longitudinal dimension of the first fabric panel and a transverse dimension substantially less than the transverse dimension of the first panel, the second panel having a first flap surface and a second flap surface, each flap surface bearing a design corresponding to the designs on opposite surfaces of the first panel such that the design on the first flap surface is coordinated with the design of the first skirt surface and the design of the second flap surface is coordinated with the design of the second skirt surface; and a dual-sided elongated attachment strip having first adhering means and second adhering means affixed to opposite sides of the strip, each adhering means adapted to engage a mating element affixed along an outer edge of the base structure to be skirted, the attachment strip connecting adjacent longitudinal edges of the first panel and the second panel so that the panels extend from opposite edges of the attachment strip, and the first skirt surface and the second flap surface form a common face, and the second skirt surface and the first flap surface form a common face.

2. The skirting assembly of claim 1 wherein:

the first panel and the second panel consist of a linen type fabric with a different design on opposite surfaces of the panels.

3. The skirting assembly of claim 1 wherein:

the color of the design on the first skirt surface is different from the color of the design on the second skirt surface.

4. The skirting assembly of claim 3 wherein:

the color of the design on the first skirt surface matches the color of the design on the first flap surface; and the color of the design on the second skirt surface matches the color of the design on the second flap surface.

5. The skirting assembly of claim 1 wherein:

the pattern of the design on the first skirt surface is different from the pattern of the design on the second skirt surface.

6. The skirting assembly of claim 5 wherein:

the pattern of the design on the first skirt surface matches the pattern of the design on the first flap surface; and the pattern of the design on the second skirt surface matches the pattern of the design on the second flap surface.

7. The skirting assembly of claim 1 wherein:

the first panel consists of a linen type fabric; and the second panel consists of a lace type fabric.

8. The skirting assembly of claim 1 wherein:

the first adhering means and the second adhering means of the attachment strip consist of a VELCRO type material.

9. The skirting assembly of claim 1 wherein:

the adhering means consist of a series of snap elements affixed on opposite sides of the attachment strip.

10. The skirting assembly of claim 1 wherein:

the designs on the first skirt surface and the second skirt surface have non-contrasting colors.

11. The skirting device of claim 1 wherein:

the designs on the first skirt surface and the first flap surface have a pattern with a darker colored background; and the design on the second skirt surface and the second flap surface is a solid color substantially the same as the background.

12. The skirting assembly of claim 1 wherein:

the first fabric panel is gathered along its longitudinal edge extending from the attachment strip.

13. The skirting assembly of claim 1 wherein:

the first fabric panel is pleated along its longitudinal edge extending from the attachment strip.

* * * * *

UNITED STATES PATENT AND TRADEMARK OFFICE

CERTIFICATE OF CORRECTION

PATENT NO. : 5,240,758

DATED : August 31, 1993

INVENTOR(S) : KAREN HONIGBERG

It is certified that error appears in the above-identified patent and that said Letters Patent is hereby corrected as shown below:

Column 5, line 32 after the word "strip" the word "connecting" should be deleted and the phrase --being connected along-- should be substituted therefor.

Signed and Sealed this

Fourteenth Day of December, 1993

*Attest:*

Bruce Lehman

BRUCE LEHMAN

*Attesting Officer*

*Commissioner of Patents and Trademarks*